US008661569B2

(12) United States Patent
Baek

(10) Patent No.: US 8,661,569 B2
(45) Date of Patent: Mar. 4, 2014

(54) FUNCTIONAL UNDERPANTS FOR MEN

(76) Inventor: Gyeong-Su Baek, Masan-si (KR)

( * ) Notice: Subject to any disclaimer, the term of this patent is extended or adjusted under 35 U.S.C. 154(b) by 158 days.

(21) Appl. No.: 13/259,714

(22) PCT Filed: Dec. 14, 2009

(86) PCT No.: PCT/KR2009/007459

§ 371 (c)(1),
(2), (4) Date: Sep. 23, 2011

(87) PCT Pub. No.: WO2010/120030

PCT Pub. Date: Oct. 21, 2010

(65) Prior Publication Data

US 2012/0017356 A1 Jan. 26, 2012

(30) Foreign Application Priority Data

Apr. 13, 2009 (KR) ..... 10-2009-0031932

(51) Int. Cl.
*A41B 9/02* (2006.01)

(52) U.S. Cl.
USPC ..... 2/403; 2/400

(58) Field of Classification Search
USPC ..... 2/403, 466, 400, 401, 404, 405
See application file for complete search history.

(56) References Cited

U.S. PATENT DOCUMENTS

2004/0003451 A1 1/2004 Yu
2008/0052807 A1 3/2008 Lai

FOREIGN PATENT DOCUMENTS

JP 2007070785 3/2007
KR 20-0333787 11/2003
KR 20-0346580 3/2004
KR 10-0835013 5/2008

OTHER PUBLICATIONS

International Search Report—PCT/KR2009/007459 dated Aug. 4, 2010.

Chinese Office Action—Chinese Application No. 200980158476.5 issued on May 6, 2013, citing JP2007070785.

*Primary Examiner* — Khoa Huynh
*Assistant Examiner* — Andrew W Collins
(74) *Attorney, Agent, or Firm* — Cantor Colburn LLP

(57) ABSTRACT

Functional underpants comprise a penis support member having a double structure comprising an outer cloth and an inner cloth, a scrotum support member having a single structure and being formed vertically under and connected to the penis support member, and a rear member connected to a lower end of the scrotum support member having the single structure. The outer cloth of the penis support member includes a first bending section, a second bending section having a horizontal length and formed under the first bending section, and a first curved portion formed between the first and second bending sections, which create a penis pocket along with the inner cloth of the penis support member. The scrotum support member includes the second bending section, a third bending section, and a second curved portion formed between the second and third bending sections, which form a scrotum pocket.

3 Claims, 5 Drawing Sheets

(Incise left and right sides of anal region by predetermined size)

(Pull up and connect left and right incised portions by means of sewing)

FUNCTIONAL UNDERPANTS FOR MEN

TECHNICAL FIELD

The present invention relates to functional underpants for men, in which a penis pocket and a scrotum pocket are independently formed, thereby securing air permeability and improving sexual health of a wearer.

BACKGROUND ART

Recently, following the vitalization of various leisure activities, such as sports and mountain climbing, which cause one to perspire a large amount, men, as well as women, have taken greater interest in functional innerwear, such as underpants.

According to medical reports, when a temperature of the scrotum of a man is about 33.5° C., the scrotum generates the healthiest sperm, and when the temperature of the testicles in the scrotum rises even by 1° C., the function of the scrotum may deteriorate. Further, if a temperature of the scrotum rises by 35° C. or higher, a risk of aspermia has been documented (reported by a research team of Dr. Patrick Tono: Laboratory for male-sterility in France Toulouse, June, 2000).

Especially, when the male sex hormone is produced in abundance, men are healthy and active. However, when a man wears existing triangle-shaped underpants (briefs) or quadrangle-shaped underpants (boxers), the penis instantly descends again due to the space between the penis and the scrotum. As a result, the penis is in contact with the testicles so that heat is generated, and when the penis and the testicles sweat, various bacteria are generated thereby generating a bad smell, and when the penis is unclean, this exerts a bad influence on the health of the uterus of a woman as well.

Therefore, it is necessary to research and develop the underpants for men to be segmented through a design based on the human engineering such that the penis is prevented from being in contact with the scrotum, and previously functional underpants have been researched and developed by many researchers.

An example of the functional underpants for men is proposed in Korea Utility Model Registration Publication No. 20-0248176 (hereinafter, referred to as 'invention 1') and Korea Utility Model Registration Publication No. 20-0346580 (hereinafter, referred to as 'invention 2').

In invention 1, underpants 1 include corrugated portions 3 formed at a central part and left and right sides of a front surface of the underpants 1 by tightly sewing left and right sides of a predetermined portion in a streamlined shape, and a first protruding portion 3-1 in which the penis (A) can be positioned on an upper side of the corrugated portions 3, and a second protruding portion 3-2 in which the scrotum (B) can be positioned on a lower side of the corrugated portions 3. Therefore, the underpants 1 can prevent the penis from leaning to the scrotum region or the groin region to prevent the sweating caused by the direct skin contact, thereby preventing skin inflammation, such as eczema (see FIG. 1A).

Further, in invention 2, underpants include an inner cloth 20 and an outer cloth 10, and the inner cloth 20 positioned in a central portion within the underpants is formed to be shorter than the outer cloth 10 such that the inner cloth 20 accommodates only the penis, not the scrotum. The inner cloth 20 is formed of a spandex material having resilience or a band 30 having enough strength to maintain a supporting state is attached to the lower end of the inner cloth 20. Further, when the inner cloth 20 and the outer cloth 10 are sewed while being set on the inside of the outer cloth 10, a bending portion corresponding to a line of the penis and the scrotum is formed in the outer cloth 10 and the inner cloth 20, so that the penis can be always separated from the scrotum while a wearer wears the underpants and thus the air is well ventilated (see FIG. 1B).

However, the multiple corrugated portions 3 and the first protruding portion 3-1 among the constitutional elements of invention 1 can sufficiently hold the penis (A) such that the penis (A) faces the hypogastric center under the navel in a state of the moderate erection of the penis (A). Otherwise, when a wearer strenuously exercises or greatly moves, there is a high possibility in that the penis (A) leans toward the left or right side or descends to the groin side again.

Further, among the constitutional elements of invention 2, the inner cloth, which is formed and sewn to be bent together with the outer cloth, is characterized in that it is formed of a spandex material having resilience or the band 30 is attached to the lower end of the inner cloth so as to separate the penis from the scrotum. However, in investigating the function of separating the penis and the scrotum of invention 2 including the above cloth as the constitutional element in detail, it can be seen that the cutting shape of the spandex material or the shape of the inner cloth fails to have the portion that is sufficiently bent, and the penis and the scrotum are almost supported and separated substantially by the band. Therefore, in invention 2, it is essentially required to add a band in manufacturing the underpants, thereby causing an increase in the number of processes, and an increase in manufacturing costs. Further, the function of separating the penis and the scrotum may be changed depending on the material of the used band and if the material of the used band is not good, it may cause the unpleasant feeling of a wearer as well.

Especially, in investigating inventions 1 and 2 in more detail, in order to completely surround the scrotum through 'the second protruding portion 3-2 and a rear member surrounding a hip portion' (see invention 1) and 'a scrotum support portion and a rear portion of the outer cloth' (see invention 2), the lower portion of the second protruding portion and the upper portion of the rear member are connected by means of sewing, or the lower portion of the scrotum support portion and the upper portion of the rear portion of the outer cloth are connected by means of sewing. In this time, a curved portion and a section having a predetermined size r (a curvature) should be formed such that the members simultaneously applies contractile force and tension to the penis region and the scrotum region while a wearer wears the underpants. However, the actual underpants do not have the above configuration. Therefore, inventions 1 and 2 still have a problem in that when the two testicles of the scrotum having different sizes contract/expand according to personal physical changes, there is no interoperation between the scrotum and scrotum support member that can be generated due to the gravity applied to the testicles of the scrotum since the scrotum support member cannot completely surround the scrotum, and the scrotum may apply pressure to the groin region, thereby causing a sexual health problem according to a failure of the obtainment of air permeability.

DISCLOSURE

Technical Problem

Accordingly, the present invention has been made to solve the above-mentioned problems occurring in the prior art, and the present invention provides functional underpants for men, in which a plurality of curved portions and a plurality of sections having a predetermined size r are formed between a penis support member having a double structure, a scrotum support member having a single structure and a rear member and connected to each other by means of sewing, so that a penis pocket and a scrotum pocket are generated. Therefore, the functional underpants can completely separate the penis and the scrotum from each other by tension and contractile force while a wearer wears the underpants, thereby securing the air permeability and further improving sexual health as well.

Technical Solution

In accordance with an aspect of the present invention, there are provided functional underpants for men for securing air permeability and improving sexual health, the functional underpants comprising:

a penis support member including a functional member and means of the functional member and having a double structure comprising an outer cloth and an inner cloth;

a scrotum support member having a single structure and being inserted between the outer cloth and the inner cloth of the penis support member having the double structure by sewing; and a rear member connected to a lower end of the scrotum support member having the single structure and to the left and right sides of the outer cloth of the front portion of the underpants by means of sewing, characterized in that a penis pocket and a scrotum pocket are generated, respectively, due to application of tension and contractile force to the penis support member and the scrotum support member while a wearer wears the functional underpants, by a first bending section, a second bending section, a third bending section, a first curved portion, and a second curved portion provided at the penis support member, the scrotum support member and the rear member, wherein the first bending section is formed by, when an entirety of the penis support member is divided into three segments along a horizontal axis, a first segment from the upper portion of the penis support member being cut in a vertical direction so as to be narrower than the first curved portion which occupies the remaining two segments of the penis support member and has a predetermined curvature and the first segment being connected with the upper end of the remaining two segments by sewing;

the second bending section is formed by being cut to have the first curved portion which is connected to the first bending section and has the predetermined curvature such that the remaining two segments of the segmented penis support member form a parabola when being folded in half, and by being connected to an upper end of the scrotum support member by means of sewing; and the third bending section is formed by being cut to have a second curved portion having a curvature that is larger than that of the first curved portion of the penis support member and being connected to the second bending section, and by being connected to a lower end of the scrotum support member and a lower end of the rear member by means of sewing.

According to an exemplary embodiment, the scrotum support member is formed of a material in which a ratio of a yarn with 30 to 40 deniers with respect to spandex is 95:5.

According to an exemplary embodiment, an entire contour of the penis support member is cut to have a rectangular shape and then is connected to the front portion of the functional underpants by means of sewing such that the penis faces the hypogastic center under the navel by tension while a wearer wears the functional underpants.

According to an exemplary embodiment, a connected part between the lower end of the penis support member and the upper end of the scrotum support member, and a connected part between the lower end of the scrotum support member and the lower end of the rear member have an identical length so that penis A and scrotum B can be completely and independently separated from each other due to contractile force applied to the penis support member and the scrotum support member by the first bending section, the second bending section and the third bending section.

According to an exemplary embodiment, the penis pocket for preventing the penis (A) from leaning toward a left or right side or descending is independently separated from the scrotum pocket for simultaneously inter-operating according to the contraction of the scrotum (B).

Advantageous Effects

Accordingly, the present invention has the following effects.

The present invention includes the penis pocket and the scrotum pocket formed by connecting the plurality of curved portions and the plurality of sections having the predetermined curvature r between the penis support member having the double structure, the scrotum support member having the single structure, and the rear member by means of sewing.

Therefore, the functional underpants of the present invention can allow the penis part and the scrotum to be completely separated from each other by tension and contractile force while a wearer wears the underpants and sufficiently secure the air permeability because the scrotum support member has the single structure.

Even when a wearer strenuously exercises or moves significantly while wearing the underpants, the present invention can prevent the penis, which initially faces the hypogastric center under the navel when a wearer wears the underpants, from leaning toward a left or right side or dropping toward the groin side, so that it is possible to prevent the generation of sweat caused by the contact of the penis with the testicles and the generation of various bacteria and a bad smell caused by sweat in advance.

When the two testicles are contracted and expanded according to personal physical changes, the scrotum pocket formed in the scrotum support member is also simultaneously and interoperably contracted and expanded, so that the present invention can prevent the generation of a sexual health problem, which is caused by the application of the pressure of the testicles of the scrotum to the groin side by gravity and a failure of the security of the air permeability, in advance.

The present invention does not adopt the conventional scheme in which the band is used, or the lower portion of the inner cloth made of a spandex material is cut to be narrow in comparison with the outer cloth and pulled up and connected to the outer cloth by means of sewing, so that there is little case in which the band or the spandex material loses the resilience even when a wearer wears the functional underpants of the present invention for a long time, thereby achieving the relatively long lifespan of the underpants.

In order to independently separate the penis and the scrotum from each other, it is completely unnecessary to use the band, or to cut the lower portion of the inner cloth made of a spandex material to be narrow in comparison with the outer cloth and pull up and connect the inner cloth to the outer cloth by means of sewing as disclosed in the conventional art, so that the present invention can omit an addition of an expensive material, such as a band, or decrease the number of operational processes, thereby reducing the manufacturing costs.

BRIEF DESCRIPTION OF THE DRAWINGS

The above and other aspects, features and advantages of the present invention will be more apparent from the following detailed description taken in conjunction with the accompanying drawings, in which.

MODE FOR INVENTION

Figure 1:
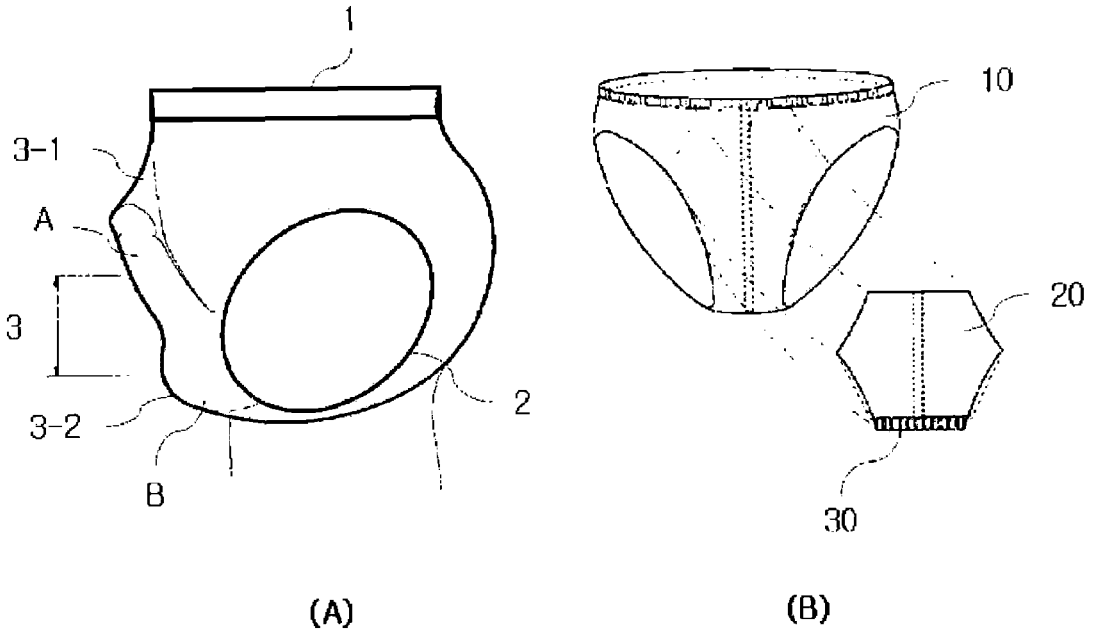
FIGS. 1A and 1B are views schematically illustrating conventional underpants for men.

Hereinafter, exemplary embodiments of the present invention will be described with reference to the accompanying drawings. The construction illustrated in the exemplary embodiments and drawings is merely the preferred embodiments of the present invention, and does not speak for the technical sprit of the present invention. In the following description, the same elements will be designated by the same reference numerals although they are shown in different drawings. Further, in the following description, detailed explanation of known related functions and constitutions may be omitted so as to avoid unnecessarily obscuring the subject manner of the present invention.

Figure 2:
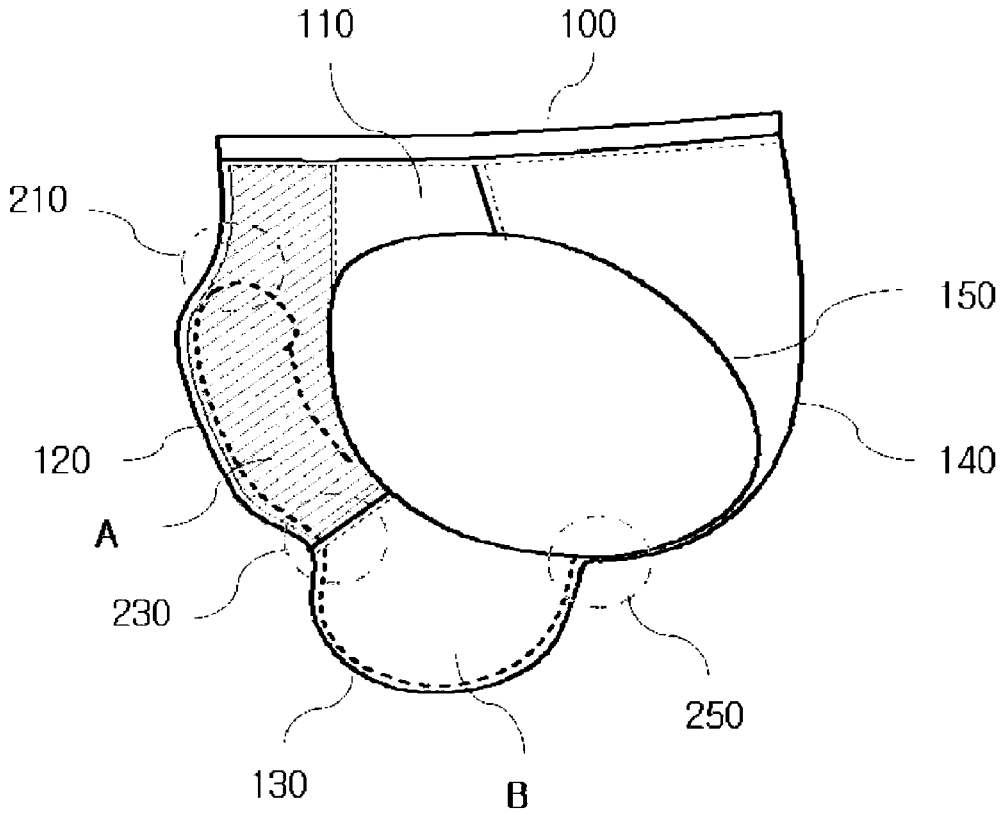
FIG. 2 is a view illustrating an entire structure of functional underpants for men according to an exemplary embodiment of the present invention.
Figure 3:
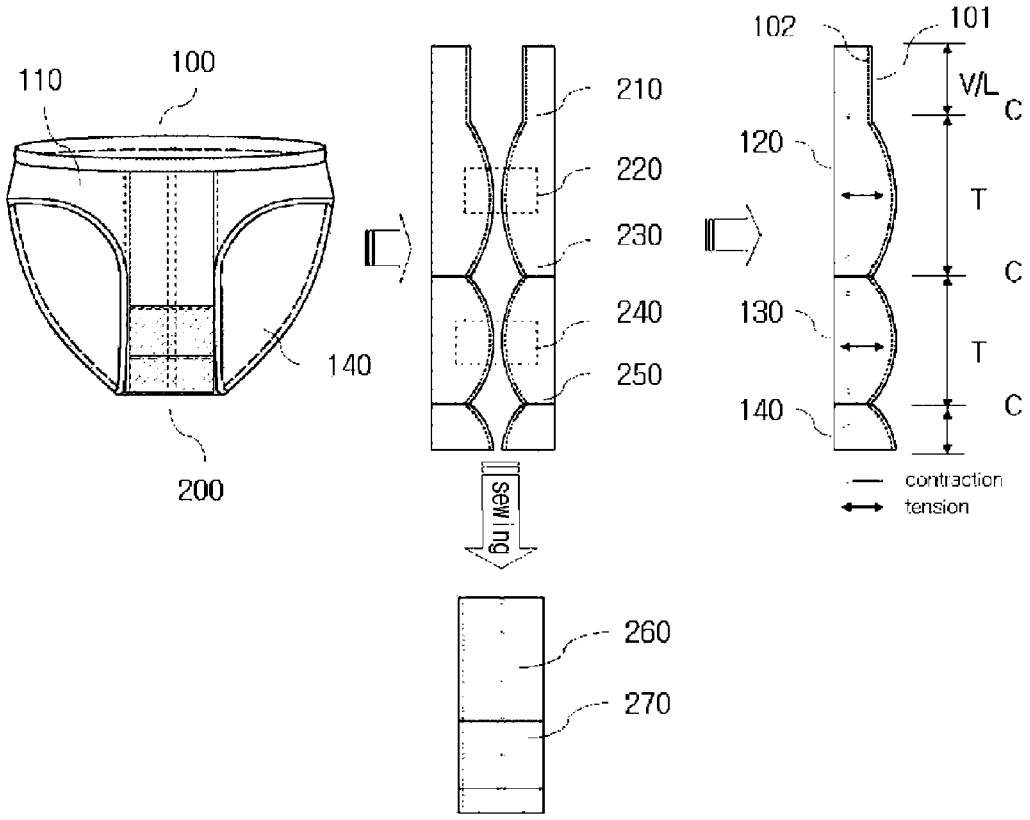
FIG. 3 is a view specifically illustrating functional parts of functional underpants for men according to an exemplary embodiment of the present invention.
Figure 4:
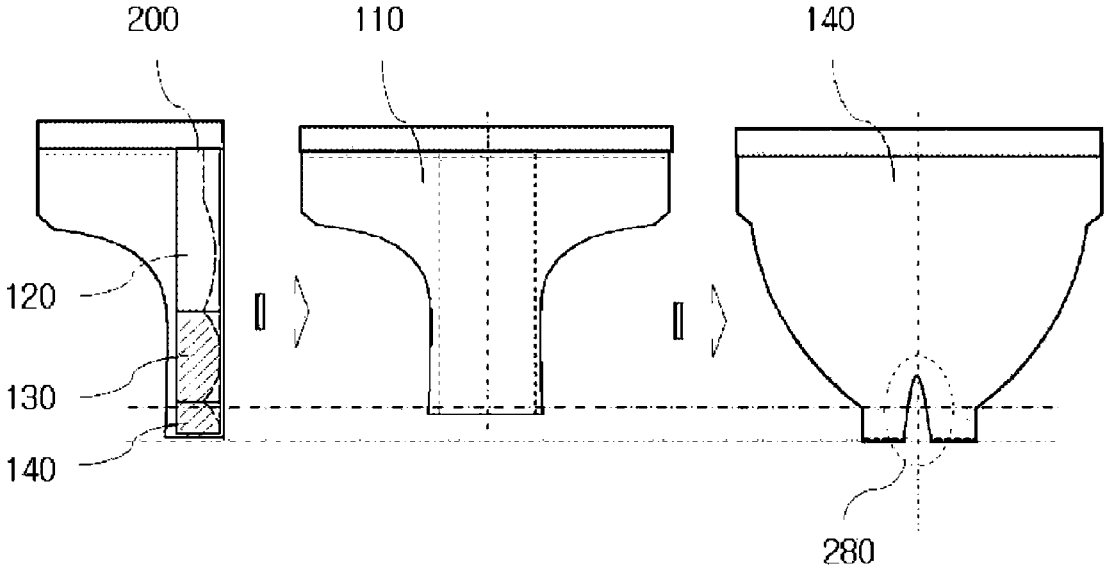
FIG. 4 is a view illustrating a front member, a rear member, and a side member of functional underpants for men according to an exemplary embodiment of the present invention.
Figure 5:
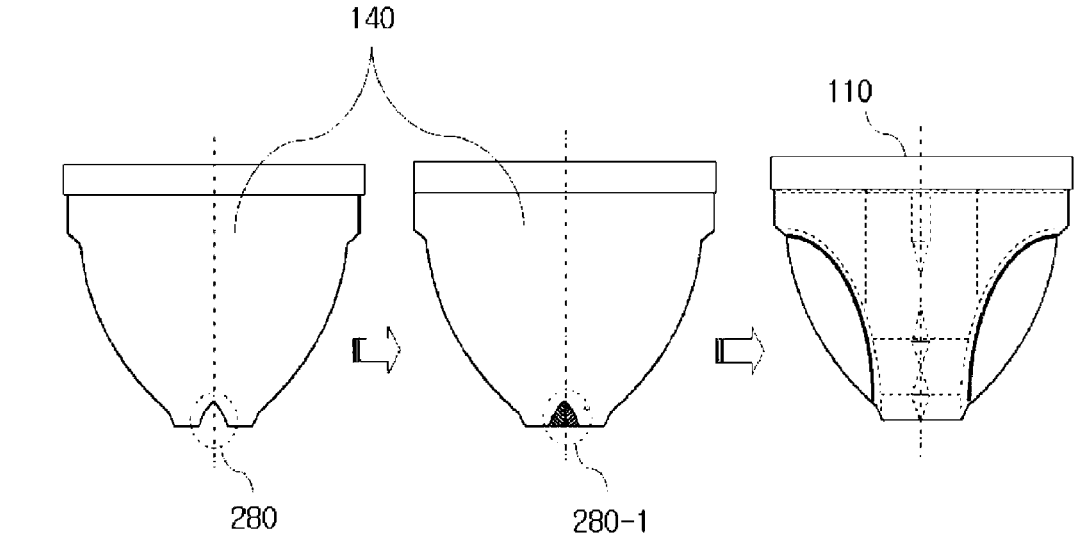
FIG. 5 is a view illustrating an incised portion of a rear member of functional underpants for men according to an exemplary embodiment of the present invention.

FIGS. 1A and 1B are views schematically illustrating underpants for men according to a conventional art, FIG. 2 is a view illustrating an entire structure of functional underpants for men according to an exemplary embodiment of the present invention, FIG. 3 is a view specifically illustrating functional parts of functional underpants for men according to an exemplary embodiment of the present invention, FIG. 4 is a view illustrating a front member, a rear member, and a side member of functional underpants for men according to an exemplary embodiment of the present invention, and FIG. 5 is a view illustrating a section of a rear member of functional underpants for men according to an exemplary embodiment of the present invention.

An essential technical construction of the functional underpants 100 for men according to an exemplary embodiment of the present invention includes a front member 110, a penis support member 120 having a double structure, a scrotum support member 130 having a single structure, a rear member 140, first through third bending sections 210, 230, and 250, first and second curved portions 220 and 240, a penis pocket 260, and a scrotum pocket 270.

Referring to FIG. 2, the present invention has a general structure of underpants in which the front member 110 and the rear member 140 are connected by means of sewing, and especially includes functional members and their means formed at a front portion of the underpants. In detail, the present invention includes the penis support member 120 having the double structure including an outer cloth 101 and an inner cloth 102 and the scrotum support member 130 having the single structure inserted between and connected with the outer cloth 101 and the inner cloth 102 of the penis support member 120 by means of sewing.

The penis support member 120 is a means for supporting the penis such that the penis of a man always faces the hypogastric center under the navel while a man wears the underpants, has the double structure formed of the outer cloth 101 and the inner cloth 102, and is connected to the front member 110 of the underpants 100.

In detail, an entire contour of the penis support member 120 is cut to have a rectangular shape so as to allow the penis to face the hypogastric center under the navel by tension while a wearer wears the underpants and then the penis support member 120 is formed at the front member 110 of the underpants 100 by means of sewing.

The outer cloth 101 may be made of tencel, which is called 'Lyo Cell' which is a new type of fiber of refined cellulose and is a compound word of 'Lyo' meaning a solvent in the Greek language and 'Cell' of cellulose. Here, the tencel improves on a decisive disadvantage of a cellulose fiber, such as artificial silk, to obtain a soft tactile sensation next to that of silk and a great drape property of sagging wrinkles, and has a hydroscopic property like a natural fiber and a strong durability comparable with polyester, so that it is a 100% chemical-free fiber which solves a problem of environmental pollution in that it can be simply water-cleaned.

The inner cloth 102 may be made of a spandex material having excellent resilience.

Meanwhile, the scrotum support member 130 having the single structure is formed by the upper portion being inserted and connected between the outer cloth 101 and the inner cloth 102 of the penis support member 120 having the double structure by means of sewing and then the lower portion being connected to the lower end of the rear member 140 by means of sewing. The scrotum support member 130 is formed of a functional member to surround the scrotum. The scrotum support member 130 is formed in the single structure including the outer cloth 101, which discharges heat generated by strenuous exercise or a large amount of movement while a wearer wears the underpants and offers air permeability so as to prevent the wrinkles of the scrotum from sweating.

The penis support member 120 and the scrotum support member 130 are made of a material containing a spandex, and the scrotum support member 130 especially is formed of a material in which the ratio of yarn with 30 to 40 deniers with respect to the spandex is 95:5.

Referring to FIGS. 2 to 5, the rear member 140 is a functional member which is connected to the lower end of the scrotum support member 130 having the single structure and the sides of the left and right surfaces of the outer cloth 101 of the front member 110 by means of sewing. The rear member 140 includes an incised portion 280 formed at the lower end of the rear member 140 and incised with a predetermined curvature in order to supplement a function of the scrotum pocket 260 which will be described later.

The incised portion 280 is connected to an incised portion (not shown) incised at the lower end of the scrotum support member 130 by means of sewing (see the third bending section 250 of FIG. 3).

Meanwhile, referring to FIGS. 2 and 3, the first bending section 210, the second bending section 230, and the third bending section 250 are functional means configured to independently and completely separate the penis A and the scrotum B from each other and simultaneously make the penis always face the hypogastric center under the navel while a wearer wears the underpants. The first bending section 210, the second bending section 230, and the third bending section 250 are cut and connected with each other by means of sewing. At this time, the cutting is made in such a manner that the first ending section 210, the second bending section 230 and the third bending section 250 can be symmetrical to each of the penis support member 120, the scrotum support member 130 and the rear member 140 with respect to the central line. In addition, the cutting is made in such a manner that the penis support member 120, the scrotum support member 130 and the rear member 140 can protrude compared to each of the upper and lower ends of the penis support member 120, the upper and lower ends of the scrotum support member 130, and the lower end of the rear member 140 such that the penis support member 120, the scrotum support member 130 and the rear member 140 can have predetermined curvatures to form a convex shape.

The first bending section 210, the second bending section 230, and the third bending section 250 will be described with reference to FIG. 3 in more detail.

The first bending section 210 is formed by, when an entirety of the penis support member 120 is divided into three segments along a horizontal axis, a first segment from the upper portion of the penis support member 120 being cut in a vertical direction so as to be narrower than the first curved portion 220 which occupies the remaining two segments of the penis support member 120 and has a predetermined curvature, and the first segment being connected with the upper end of the remaining two segments by sewing.

Further, the second bending section 230 is formed by being cut to have the first curved portion 220 which is connected to the first bending section 210 and has the predetermined curvature such that the remaining two segments of the segmented penis support member 120 form a parabola when being folded in half, and by being connected to an upper end of the scrotum support member 130 by means of sewing.

The third bending section 250 is formed by being cut to have a second curved portion 240 which is connected to the second bending section 230 and has a curvature that is larger than that of the first curved portion 220 of the penis support member 120, and by being connected to a lower end of the scrotum support member 130 and a lower end of the rear member 140 by means of sewing.

The connected part between the lower end of the penis support member 120 and the upper end of the scrotum support member 130, and the connected part between the lower end of the scrotum support member 130 and the lower end of the rear member 140 may have an identical length so that the penis A and the scrotum B can be completely and independently separated from each other due to contractile force applied to the penis support member 120 and the scrotum support member 130 by the first bending section 210, the second bending section 230 and the third bending section 250.

Meanwhile, referring to FIG. 3, the first curved portion 220 and the second curved portion 240 are functional means configured to generate a penis pocket 260 and a scrotum pocket 270, which will be described later, for surrounding the separated penis A and scrotum B and have predetermined curvatures. The curvature of the second curved portion 240 of the scrotum support member 130 is slightly larger than that of the first curved portion 220 of the penis support member 120 according to the characteristic of the scrotum.

Referring to FIG. 3, the penis pocket 260 and the scrotum pocket 270 are the means which support the independently separated penis A and are interoperated with a contraction of the scrotum B. Therefore, the penis pocket 260 and the scrotum pocket 270 prevent the penis A from leaning toward the left or right side or instantly descending toward the groin side again when a wearer strenuously exercises or moves significantly while wearing the underpants.

When the scrotum B is dropped due to contraction in accordance with personal physical changes according to the characteristic of the two testicles having different sizes by gravity, the scrotum pocket 270 is configured to fully surround the scrotum B so that the scrotum pocket 270 and the scrotum B can together inter-operate with each other.

An operation of the functional underpants for men according to the exemplary embodiment of the present invention will be described in more detail.

A uniquely conceived functional member 200, i.e. the penis support member 120 having the double structure, the scrotum support member 130 having the single structure, and the rear member 140, connected to the front portion of the underpants 100 includes the plurality of curved portions 220 and 240 having a predetermined curvature and the bending sections 210, 230, and 250 such that the penis pocket 260 and the scrotum pocket 270 are generated through sewing the curved portions and the sections. Here, the curved portion 240 of the scrotum support member 130 has a curvature slightly larger than the first curved portion 220 of the penis support member 120 according to the characteristic of the scrotum. Therefore, the functional underpants 100 allow the penis A and the scrotum B to be independently and completely separated from each other by the penis pocket 260 and the scrotum pocket 270 to sufficiently offer the air permeability to the sexual organs and prevent the penis A from leaning toward the left or right side or dropping by the penis pocket 260 as well. Further, when the scrotum is dropped due to contraction in accordance with personal physical changes according to the characteristic of the two testicles having different sizes by gravity, the scrotum pocket 270 simultaneously inter-operates in accordance with the dropping of the scrotum and fully surrounds the scrotum B, thereby further improving sexual health. Furthermore, the functional underpants 100 of the present invention do not use an expensive material or a specific band capable of creating an unpleasant feeling in contrast to that of the conventional art, so that it is possible to greatly reduce the manufacturing costs through decreasing the operation process.

The foregoing is merely an exemplary embodiment of the technical sprit of the present invention and it will be readily understood by those skilled in the art that various modifications and changes can be made thereto within the technical spirit and scope of the present invention. Thus, the exemplary embodiment disclosed in the present invention is not for limiting the technical sprit, but for describing it, and the present invention is not limited thereto. The protection scope of the present invention shall be interpreted by the appended claims and all of the technical sprit within its equivalent scope shall be understood to be included in the claims of the present invention.

INDUSTRIAL APPLICABILITY

The present invention is related to the clothes industry, and more particularly to functional underpants for men including a penis pocket and a scrotum pocket for securing air permeability and improving sexual health.

The invention claimed is:

1. Functional underpants for men for securing air permeability and improving sexual health, the functional underpants comprising:

a penis support member (120) having a double structure comprising an outer cloth (101) and an inner cloth (102);

a scrotum support member (130) having a single structure and being formed vertically under and connected to the penis support member; and a rear member (140) connected to a lower end of the scrotum support member (130) having the single structure, wherein the outer cloth (101) of the penis support member includes a first bending section (210) having a horizontal length and formed separately from and under a waistband of the functional underpants, a second bending section (230) having a horizontal length and formed under the first bending section, and a first curved portion (220) formed between the first and second bending sections (210, 230), the first curved portion (220) having a first curvature maximum horizontal length and the first curvature maximum horizontal length being longer than those of the first and second bending section horizontal lengths to thereby create a penis pocket (26) along with the inner cloth (102) of the penis support member;

wherein the scrotum support member (130) includes the second bending section (230), a third bending section (250) having a horizontal length, and a second curved portion (240) formed between the second and third bending sections (230, 250), the second curved portion (240) having a second curvature maximum horizontal length and the second curvature maximum horizontal length being longer than those of the second and third bending section horizontal lengths to thereby form a scrotum pocket (270);

wherein the penis support member (120) forms a first separate patch sewn to the functional underpants, and the scrotum support member (130) form a second separate patch sewn to the functional underpants; and wherein the first curvature maximum horizontal length is shorter than the second curvature maximum horizontal length, and the outer sewn edge of the first separate patch having a rectangular shape for substantially preventing a penis (A) from wobbling in the horizontal direction.

2. The functional underpants as claimed in claim 1, wherein the scrotum support member (130) is formed of a material in which a ratio of a yarn with 30 to 40 deniers with respect to spandex is 95:5.

3. The functional underpants as claimed in claim 1, wherein a connected part between the lower end of the penis support member (120) and the upper end of the scrotum support member (130), and a connected part between the lower end of the scrotum support member (130) and the lower end of the rear member (140) have an identical length so that penis A and scrotum B can be completely and independently separated from each other due to contractile force applied to the penis support member (120) and the scrotum support member (130) by the first bending section (210), the second bending section (230) and the third bending section (250).

* * * * *